United States Patent [19]

Odagiri et al.

[11] Patent Number: 4,690,568

[45] Date of Patent: Sep. 1, 1987

[54] BATTERY LIFETIME INDICATOR FOR A STOPWATCH

[75] Inventors: Hiroshi Odagiri; Isamu Nishida, both of Tokyo, Japan

[73] Assignee: Seiko Instruments & Electronics Ltd., Tokyo, Japan

[21] Appl. No.: 783,765

[22] Filed: Oct. 3, 1985

[30] Foreign Application Priority Data

Oct. 5, 1984 [JP] Japan ..... 59-209359

[51] Int. Cl.[4] ..... G04B 1/00

[52] U.S. Cl. ..... 368/204; 368/107; 368/113; 368/66

[58] Field of Search ..... 368/107, 108–113, 368/204, 203, 66, 80

[56] References Cited

U.S. PATENT DOCUMENTS 4,219,999 9/1980 Ichikawa ..... 368/66
4,244,039 1/1981 Laesser ..... 368/66
4,316,274 2/1982 Ushikoshi ..... 368/66
4,537,514 8/1985 Moriya .

FOREIGN PATENT DOCUMENTS 19475 2/1981 Japan ..... 368/66

*Primary Examiner*—Bernard Roskoski
*Attorney, Agent, or Firm*—Bruce L. Adams; Van C. Wilks

[57] ABSTRACT

In an indication hand type stopwatch energized by a battery having a second indication hand, a minute indication hand and an hour indication hand, a battery lifetime display has a battery lifetime detective section for monitoring a voltage of the battery and a battery lifetime display circuit means connected to the battery lifetime detective section and for controlling the driving of the minute indication hand serving as a battery lifetime indication hand for displaying a battery lifetime while the stopwatch is in a non-counting mode.

In the case that the battery voltage is over the predetermined voltage, the minute indication is driven by 15 steps clockwise in response to the operation of an external operation switch and in the case that the battery voltage is below the predetermined voltage, the minute indication is driven by 3 steps.

18 Claims, 6 Drawing Figures

BATTERY LIFETIME INDICATOR FOR A STOPWATCH

BACKGROUND OF THE INVENTION

This invention relates to a battery lifetime indicator of an indication hand type stopwatch or chronograph.

Conventionally, a battery lifetime indication has not been made in the indication hand type stopwatch or chronograph.

Normally, the battery lifetime indication of the indication hand type watch has been executed by the change of indication hand driving period as disclosed in U.S. Pat. No. 4,014,164 to Kinji Fujita.

However, it is difficult for the indication hand type stopwatch or chronograph to change the indication hand driving period, because the stopwatch is a measuring device for indicating an elapsed time.

As a result of it, the battery lifetime display which has been used for a general indication hand type watch has not been adopted in the indication hand type stopwatch or chronograph.

SUMMARY OF THE INVENTION

An object of this invention is to provide a battery lifetime indicator for indicating a battery lifetime with a predetermined rotational angle position of the indication hand during non-counting period of the stopwatch or the like.

Another object of this invention is to provide a battery lifetime display for a stopwatch in which a battery lifetime indication is executed by changing the position of the indication hand in response to the monitoring result of the battery voltage when the stopwatch receives a switch input for a battery lifetime monitor at the non-counting mode.

A further object of this invention is to provide a battery lifetime display of an indication hand type stopwatch which comprises a battery lifetime detection circuit means for detecting a voltage of the battery, and a battery lifetime display circuit means connected to the battery lifetime detection circuit means, for controlling the driving of an indication hand for indicating a battery lifetime in response to an operation of an external operation switch during non-counting period of the stopwatch.

PREFERRED EMBODIMENT OF THE INVENTION

Hereinafter, one embodiment of this invention will be described with reference to the drawings.

Figure 1:
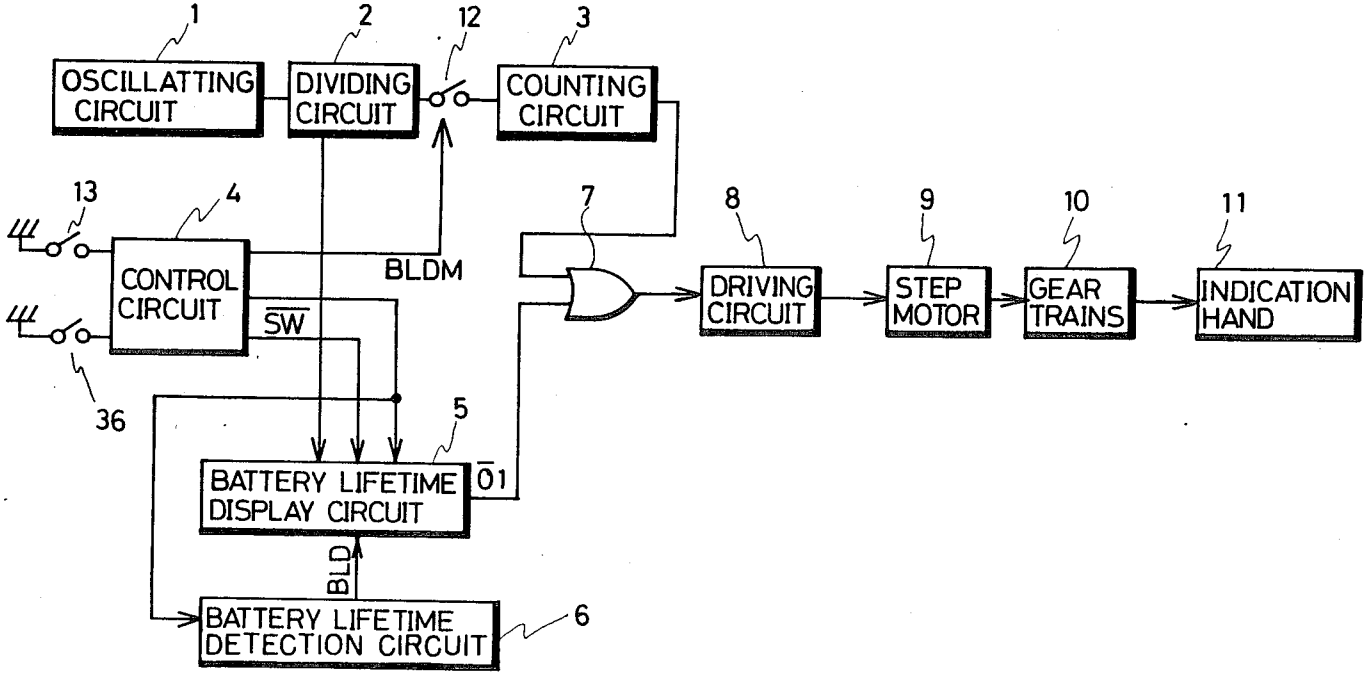
FIG. 1 is a block diagram showing an embodiment of this invention.

FIG. 1 is a block diagram showing an embodiment of this invention.

In FIG. 1, the reference numeral 1 depicts an oscillating circuit for producing a reference signal for counting time, and the reference numeral 2 depicts a dividing circuit for dividing the oscillating output signal of the oscillating circuit 1 so as to apply a divided frequency signal of the dividing circuit to a battery lifetime display circuit 5 and to output a reference signal for measuring an elapsed time through switch 12 to a counting circuit 3.

The counting circuit 3 counts the reference signal from the dividing circuit 2 and outputs a driving pulse to an OR gate 7.

The OR gate 7 outputs the driving pulse from the counting circit 3 and the driving pulse from the battery lifetime display circuit 5 to a driving circuit 8. The driving signals fed to the driving circuit 8 drive a step motor 9 so that an indication hand 11 driven by gear trains 10 indicates an elapsed time.

The reference numeral 13 depicts an external operation switch for starting and stopping the stopwatch, and the reference numeral 36 depicts an external operation switch for driving the indication hands of stopwatch to the original position and for commanding battery lifetime indication.

These switches are connected to an input control circuit 4 which is constructed by the sequential circuit composed of flipflops and ROM.

The control circuit 4 controls the ON and OFF states of the switch 12 for transmitting the reference signal to the counting circuit 3 according to the operation of the external switches 13, and controls the battery lifetime display circuit 5 and a battery lifetime detection circuit 6, respectively.

In a normal counting mode, the switch 12 undergoes ON or OFF operation repeatedly and the indication hand indicates a counted time.

In a battery lifetime displaying mode, the switch 12 is in the OFF state.

At this time, the output or instruction signal BLDM of the control circuit 4 which is connected to the battery lifetime display circuit 5 and the battery lifetime detection circuit 6 holds logical level "1" ($V_{DD}$) when an external switch 36 is in the ON state.

When the output instruction signal BLDM becomes logical level "1", the battery lifetime display circuit 5 is controlled to output the driving pulse output $\overline{01}$ to the OR gate 7 in response to a BLD signal or detection signal which is the output of the battery lifetime detective detection circuit 6 whereby the indication hand indicates the battery lifetime.

The output $\overline{SW}$ of the control circuit 4 comprises another instruction signal which is applied to the battery lifetime display circuit 5 and becomes logical level "1" after the display of the battery lifetime.

When the instruction signal SW is at logical level "1", the battery lifetime display circuit 5 outputs the additional driving pulse output $\overline{01}$ again and the indication hand is driven to the original or rest position.

Figure 2:
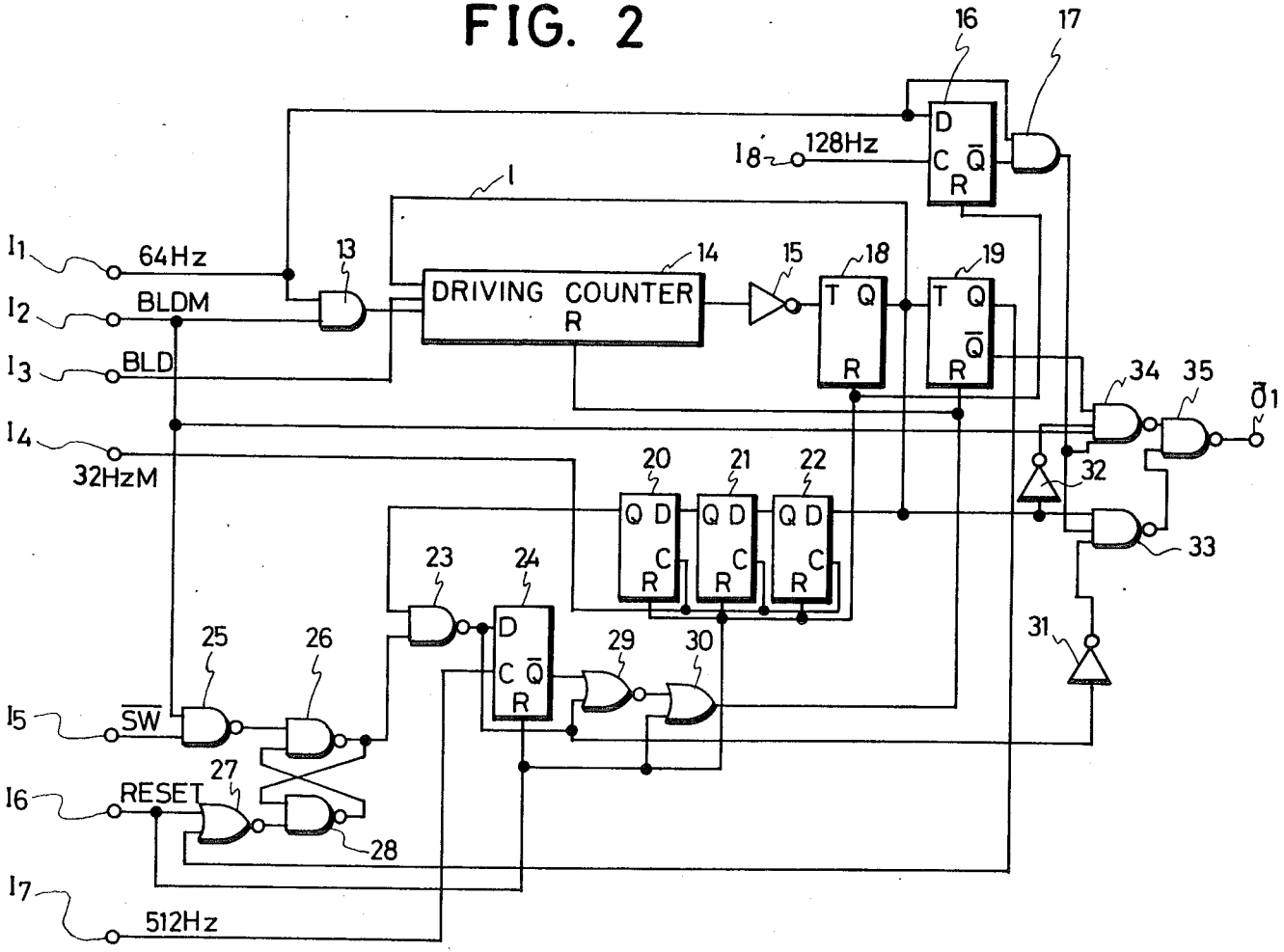
FIG. 2 shows an embodiment of the battery lifetime display circuit.

Next, FIG. 2 shows an embodiment of the battery lifetime circuit 5 used for this invention.

In FIG. 2, each of the reference numerals 16, 20, 21, 22 and 24 designates a D type flipflop (hereinafter called DF/F) for memorizing input data at the D terminal temporarily in response to a trailing edge of a clock pulse fed to the C terminal.

Each of the reference numerals 18, 19 designates T type flipflop (hereinafter, called TF/F) which changes a logic level of the outputs Q and $\overline{Q}$ in response to a trailing edge of a clock pulse fed to the T terminal.

Each of the reference numerals 23, 25, 26, 28, 33, 34 and 35 designates a NAND gate and each of the reference numerals 27 and 29 designates a NOR gate.

The reference numerals 13 and 17 designate AND gates, the reference numerals 15, 31 and 32 designate inverters, and the reference numeral 30 designates an OR gate.

Accordingly, the description of each element in FIG. 2 has been made and the operation of FIG. 2 will be described.

To the terminals $I_1$, $I_4$, $I_7$ and $I_8$ are fed 64 Hz signal, 32 HzM signal (signal advanced by 90° in phase to 32 Hz signal), 512 Hz signal and 128 Hz signal respectively.

To the terminal $I_2$ is fed the BLDM instruction signal of the logical level "1" from the control circuit the battery lifetime display mode.

To the terminal $I_3$ is fed the BLD detection signal from the battery lifetime detection circuit 6, the BLD signal changing from the logical level "1" to the logical level "0" and vice versa in response to the battery voltage.

To the terminal $I_5$ is fed the $\overline{SW}$ instruction signal so that the battery lifetime display mode is terminated.

To the terminal $I_6$ is fed the RESET signal which is produced by the simultaneous operation of the external operation switches 13 and 36 and initializes the battery lifetime display circuit 5.

A driving counter 14 is a counter the content of which changes in response to the BLD signal at the terminal $I_3$ and the output Q of TF/F 18.

Assuming now that the content of the driving counter is a predetermined number 15 on the condition that the BLD detection signal is the logical level "1" and the output Q of TF/F 18 is the logical level "0", the content changes to an additional predetermined number 45 when the BLD signal keeps the logical level "1" and the output Q of TF/F 18 changes from the logical level "0" to the logical level "1".

The battery lifetime detection circuit outputs the BLD signal depending upon the battery voltage to the terminal $I_3$, when the BLDM signal is changed to the logical level "1" by the operation of the external operation switch 36.

Figure 5:
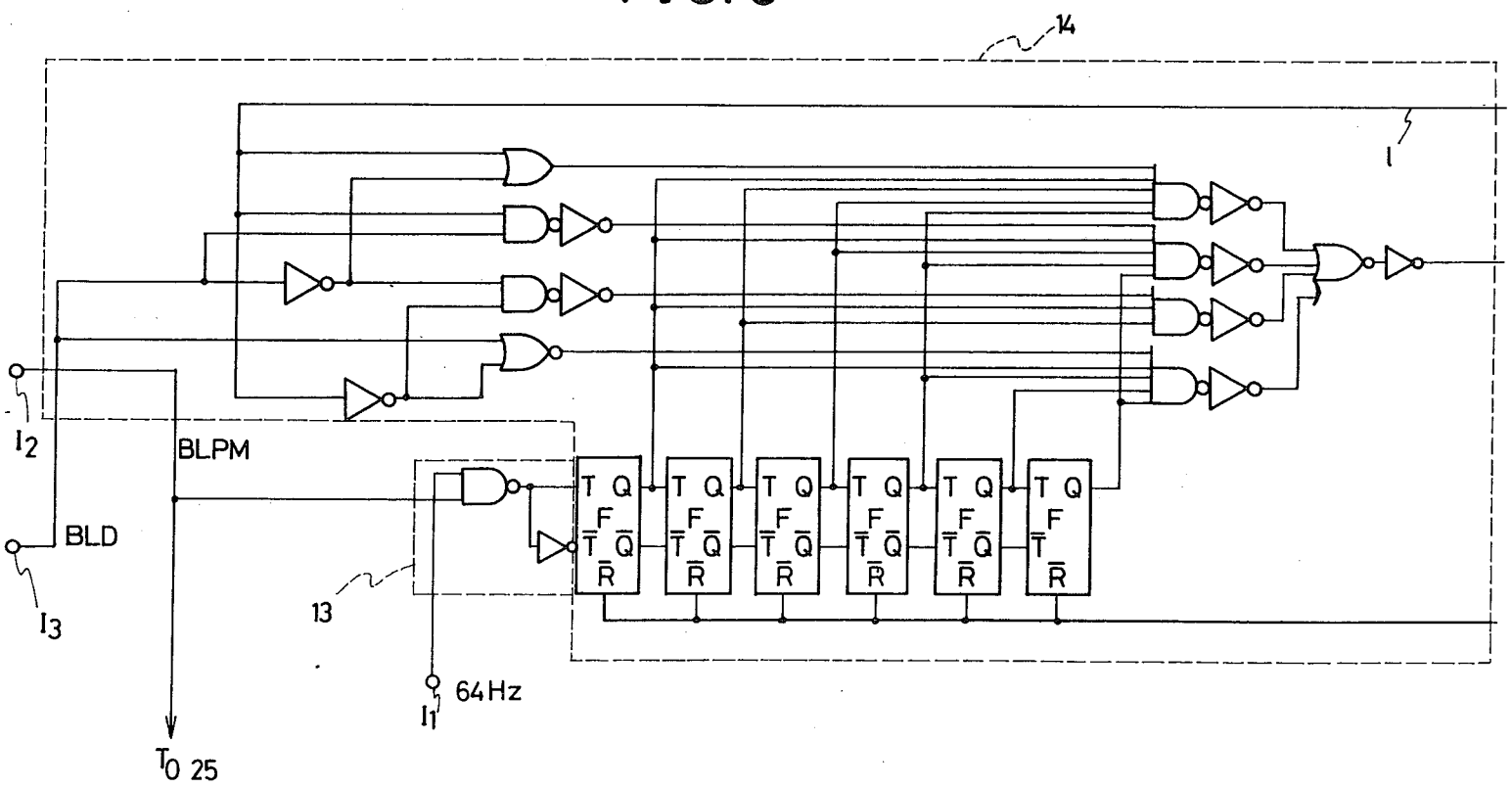
FIG. 5 shows a detailed circuit diagram of a driving counter in the battery lifetime display circuit as shown in FIG. 2.

At the same time, to the driving counter 14, the detailed circuit structure of which is shown in FIG. 5 is fed 64 Hz signal through the AND gate 13.

At this time, the content of the driving counter 14 is 15 in case that the output Q of TF/F 18 is the logical level "0" and the BLD signal is the logical level "1", and the output of the driving counter 14 changes to the logical level "1" when the driving counter 14 counts 15 pulses of the 64 Hz signal.

The driving pulse of 3.9 msec produced by the TF/F 16 and AND gate 17 is fed through NAND gates 34 and 35 to the driving circuit until the output or control signal of the driving counter 14 becomes the logical level "1".

The output Q of TF/F 18 becomes the logical level "1" in response to the output of the inverter 15, when the output of the driving counter 14 becomes the logical level "1".

The indication hand is driven by 15 steps, as the NAND gate 34 becomes closed by the inverter 32 when the output Q of TF/F or memory means 18 becomes the logical level "1".

At the same time, each of the TF/F 22, TF/F 21 and TF/F 20 delays the output Q of TF/F 18 having the logical level "1" by the timing pulse of 32 HzM to output a delayed signal having the logical level "1" to the NAND gate 23.

Herein, the $\overline{SW}$ instruction signal at the terminal $I_5$ is at the logical level "1" when the external operation switch makes turns OFF to terminate the battery lifetime display mode.

At the same time, each output of the NAND gate 26 and the NAND gate 28 constituting the RS latch circuit becomes the logical level "1".

The output of the NAND gate 23 becomes the logical level "0" when each output of the NAND gate 26 and TF/F 20 becomes the logical level "1".

The gate 29 produces the reset pulse of 1 msec pulse width at the output terminal thereof, when the output of the NAND gate 23 becomes the logical level "0".

This reset pulse resets the TF/F 19 and driving counter 14 through the OR gate 30.

After having reset these circuits, the operation for returning the indication hand to the original position is executed.

In this embodiment, the one round rotation of the indication hand constitutes 60 steps.

Accordingly, the indication hand requires additional 45 steps to return to the original position after the indication hand has driven 15 steps to display the battery lifetime.

The content of the driving counter 14 is set to the additional predetermined number 45 when the output Q of the TF/F 18 is the logical level "1" and the signal BLD is the logical level "1".

Accordingly, after resetting the driving counter 14, the driving counter 14 counts 45 pulses of 64 Hz signal.

During the counting, the driving pulse produced by the TF/F 16 and gate 17 is fed through the NAND gates 33 and 35 to the driving circuit 8.

The output of the driving counter 14 becomes the logical level "1" when the driving counter 14 counts 45 pulses of 64 Hz signal.

The output Q of the TF/F 18 changes from the logical level "1" to the logical level "0" when the output of the driving counter 14 becomes the logical level "1".

The output Q of the TF/F 19 becomes the logical level "1" in response to the output Q of the TF/F 18.

The output of the NOR gate 27 for resetting RS latch circuit composed of the NAND gates 26 and 28 becomes the logical level "0", when the output Q of the TF/F 19 becomes the logical level "1".

The output of the NAND gate 26 becomes the logical level "0" when the output of the NOR gate 27 becomes the logical level "0".

The NAND gate 33 is closed by the output of the inverter 31 as the output of the NAND gate 26 becomes the logical level "0".

As a result of it, the output $\overline{01}$ of the NAND gate 35 produces 45 driving pulses so that the indication hand returns to the original position again.

The description that the signal BLD from the battery lifetime detection circuit is the logical level "1" has been made.

In the case that the signal BLD is the logical level "0", it is possible for the indication hand to display the output of the battery lifetime detection circuit 6 with the angle deviation of the indication hand, if the content of the driving counter 14 is set to a predetermined number 3 when the output Q of TF/F 18 is the logical level "0" and the content is set to an additional predetermined number 57 when the output Q of TF/F 18 is the logical level "1".

The delaying operation of TF/F 20, TF/F 21 and TF/F 22 in the above description makes the indication hand stop temporarily in the case that the time difference between the signal BLDM and the signal $\overline{SW}$ is small because of quick operation of the external operation switch.

The indication hand is driven to the original position instead of indicating the battery lifetime when the output Q of TF/F 20 is the logical level "1" and the signal $\overline{SW}$ is the logical level "1".

However, the indication hand is possible to stay in the battery lifetime indication position during the delayed time formed by TF/F 20, TF/F 21 and TF/F 22 even if the signal $\overline{SW}$ is changed to the logical level "1" quickly by the rapid operation of the external operation switch.

It is possible for the battery lifetime indication to be held during the delayed time in the above mentioned manner even if the switch operation is quick.

Figure 3:
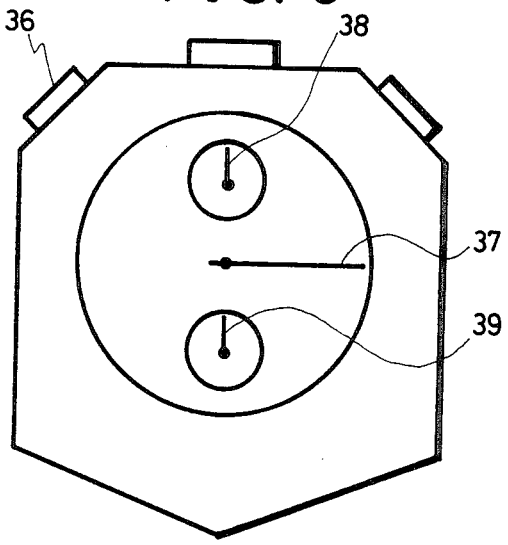
FIG. 3 is a top plan view of a stopwatch employing a battery lifetime display of this invention.

FIG. 3 shows a top plan view of the stopwatch.

The reference numerals 37, 38 and 39 are a second indication hand, a minute indication hand and an hour indication hand, respectively. The minute indication hand 38 indicates the battery lifetime with the angle deviation thereof.

Figure 4A:
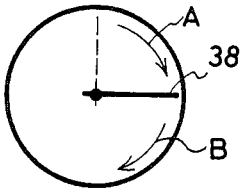
FIG. 4A and 4B show the positions of a minute indication hand serving as an indication hand for displaying a battery lifetime.

In case that the battery voltage is above a predetermined voltage, the minute indication hand 38, the one round rotation of which constitutes 60 steps is driven by 15 steps clockwise from the 00-minute position as indicated by the arrow A of FIG. 4A when the external operation switch 36 is closed in the non-counting mode.

Thereafter, the minute indication hand 38 is driven by 45 steps clockwise from the 15-minute position when the external operation switch 36 is opened.

Figure 4B:
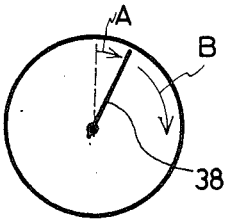

In case that the battery voltage is below the predetermined voltage, the minute indication hand 38 is driven by 3 steps clockwise from the 00-minute position as indicated by the arrow A of FIG. 4B when the external operation switch 36 is closed in the non-counting mode.

In this embodiment, the clockwise driving of the indication hand has been described.

However, the battery lifetime indication is possible to be made with the clockwise driving of the indication hand and thereafter the indication hand is driven to the original or rest position counter-clockwise, or the battery lifetime indication is possible to be made with the counter-clockwise driving of the indication hand and thereafter the indication hand is driven to the original position clockwise.

The above mentioned manner is realized by the modification of the embodiment as shown in FIG. 2.

According to this invention as described above, it is possible for the battery lifetime indication of the indication hand type stopwatch to display the battery lifetime indicated by the visible angle deviation of the indication hand whereby the judgment of the battery lifetime is made easily.

What is claimed is:

1. In a stopwatch energized by a battery and having a hand rotationally driven in a step-by-step manner by driving pulses, a battery lifetime indicator for indicating the lifetime of the battery comprising: battery lifetime detection circuit means for detecting the output voltage of the battery and generating a detection signal according to the amount of the output voltage; control means having at least one switch manually operative when the stopwatch is not being used to indicate elapsed time for generating an instruction signal to initiate the battery lifetime indicator; and battery lifetime display circuit means initiated by the instruction signal and responsive to the detection signal for generating a predetermined number of driving pulses effective to drive the hand to a predetermined rotational angular position from a rest position.

2. A battery lifetime indicator as claimed in claim 1; wherein the control means includes means for generating another instruction signal to terminate operation of the battery lifetime indicator.

3. A battery lifetime indicator as claimed in claim 2; wherein the battery lifetime display circuit means includes means responsive to the another instruction signal for generating an additional predetermined number of driving pulses effective to return the hand to the rest position.

4. A battery lifetime indicator as claimed in claim 1; wherein the battery lifetime display circuit means comprises driving counter means for setting the predetermined number therein according to the detection signal and for counting the predetermined number of driving pulses in response to the instruction signal to produce a control signal, and output control means responsive to the control signal for enabling the hand to move step by step until the hand reaches the predetermined rotational angular position.

5. A battery lifetime indicator as claimed in claim 3; wherein the battery lifetime display circuit means comprises driving counter means for setting the predetermined number therein according to the detection signal and for counting the predetermined number of driving pulses in response to the instruction signal to produce a control signal, and output control means responsive to the control signal for enabling the hand to move step by step until the hand reaches the predetermined rotational angular position, and the means for generating an additional predetermined number of drive pulses comprises memory means interconnected between the driving counter means and the output control means for memorizing the completion of generating the predetermined number of driving pulses, and circuit means responsive to the another instruction signal and the output of the memory means for applying a set signal to the driving counter means so as to set the additional predetermined number therein, the driving counter means counting the additional predetermined number of driving pules in response to the another instruction signal to enable the hand to return to the rest position.

6. A battery lifetime indicator as claimed in claim 5; wherein the means for generating an additional predetermined number of drive pulses includes delay means interconnected between the memory means and circuit means for delaying for a certain delay period the transmission of the output from the memory means to the circuit means to thereby hold the hand in the predetermined rotational position during the delay period.

7. In a stopwatch energized by a battery and having a hand rotationally driven in a step-by-step manner by driving pulses for indicating elapsed time, an indicator for indicating the lifetime of the battery comprising: battery lifetime detecting circuit means for detecing the output voltage of the battery representative of the battery lifetime and producing a detection signal according to the amount of the detected output voltage; input control means manually operative when the stopwatch is not being used to indicate elapsed time for producing an instruction signal; and battery lifetime display circuit means initiated by the instruction signal and responsive to the detection signal for producing a specified number of driving pulses to drive the hand to a specified angular position indicative of the battery lifetime.

8. As indicator as claimed in claim 7; wherein the battery lifetime detection circuit means includes means for producing a detection signal of one logical level when the output voltage of the battery is above a predetermined value and producing a detection signal of the other logical level when the output voltage of the battery is below the predetermined value.

9. An indicator as claimed in claim 7; wherein the input control means includes a switch manually operative when turned on to produce the instruction signal.

10. An indicator as claimed in claim 9; wherein the switch is operative when turned off to produce another instruction signal for terminating operation of the indicator.

11. An indicator as claimed in claim 7; wherein the battery lifetime display circuit means includes driving counter means for setting the specified number therein in response to the detection signal and for counting the specified number of driving pulses when initiated by the instruction signal to produce a control signal.

12. An indicator as claimed in claim 11; wherein the battery lifetime display circuit means includes output control means responsive to the control signal for enabling the hand to move step by step until the hand reaches the specified angular position.

13. An indicator as claimed in claim 12; wherein the input control means includes means for producing another instruction signal for terminating operation of the indicator.

14. An indicator as claimed in claim 13; wherein the battery lifetime display circuit means includes means responsive to the another instruction signal for producing an additional number of driving pulses effective to return the hand from the specified angular position to the rest position.

15. An indicator as claimed in claim 14; wherein the means for producing the additional number of driving pulses comprises means connected between the driving counter means and the output control means for detecting completion of the feeding of the specified number of the driving pulses and thereafter producing a completion signal.

16. An indicator as claimed in claim 15; wherein the means for producing the additional number of driving pulses further comprises means operative upon reception of both the another instruction signal and the completion signal for setting the additional number into the driving counter means and for enabling the driving counter means to count the additional number of driving pulses.

17. An indicator as claimed in claim 16; wherein the means for producing the additional number of driving pulses further comprises means connected between the means for detecting the completion and the means for setting the additional number for delaying the transmission of the completion signal for a certain delay period to thereby hold the hand in the specified angular position during the delay period.

18. An indicator as claimed in claim 8; wherein the battery lifetime display circuit means includes means for producing a predetermined larger number of driving pulses in response to the detection signal of the one logical level and for producing a predetermined smaller number of drive pulses in response to the detection signal of the other logical level.

* * * * *